US008813368B2

(12) United States Patent
VanHoy

(10) Patent No.: US 8,813,368 B2
(45) Date of Patent: Aug. 26, 2014

(54) FOLDING KNIFE WITH BLADE LOCKING MECHANISM

(75) Inventor: Edward Tate VanHoy, Abingdon, VA (US)

(73) Assignee: GB II Corporation, Tualatin, OR (US)

( * ) Notice: Subject to any disclaimer, the term of this patent is extended or adjusted under 35 U.S.C. 154(b) by 844 days.

(21) Appl. No.: 12/791,748

(22) Filed: Jun. 1, 2010

(65) Prior Publication Data

US 2010/0299934 A1 Dec. 2, 2010

Related U.S. Application Data

(60) Provisional application No. 61/182,225, filed on May 29, 2009.

(51) Int. Cl.
*B26B 1/04* (2006.01)

(52) U.S. Cl.
USPC ..... 30/161; 30/155; 7/168

(58) Field of Classification Search
USPC ..... 30/160, 161, 153, 155, 330, 331, 30/337–339, 519; 7/118, 168
See application file for complete search history.

(56) References Cited

U.S. PATENT DOCUMENTS

| | | | | |
|---|---|---|---|---|
| 3,942,249 | A | 3/1976 | Poehlmann | |
| 4,148,140 | A | 4/1979 | Lile | |
| 4,233,737 | A | 11/1980 | Poehlmann | |
| 4,272,887 | A | 6/1981 | Poehlmann | |
| 4,893,409 | A | 1/1990 | Poehlmann | |
| 5,964,035 | A | 10/1999 | Poehlmann | |
| 6,675,484 | B2 | 1/2004 | McHenry et al. | |
| 7,654,004 | B2 * | 2/2010 | Tsuda | 30/152 |
| 7,752,759 | B2 * | 7/2010 | Perreault | 30/161 |
| 8,028,419 | B2 * | 10/2011 | VanHoy | 30/161 |
| 2006/0168819 | A1 * | 8/2006 | Perreault | 30/161 |
| 2006/0200996 | A1 * | 9/2006 | Pearman | 30/158 |
| 2006/0260138 | A1 * | 11/2006 | VanHoy | 30/161 |
| 2007/0245570 | A1 * | 10/2007 | Tsuda | 30/161 |

* cited by examiner

*Primary Examiner* — Clark F. Dexter
(74) *Attorney, Agent, or Firm* — Klarquist Sparkman, LLP

(57) ABSTRACT

The present disclosure concerns embodiments of a folding knife having a locking mechanism for locking a blade in open and/or closed positions. The locking mechanism a first locking element on the blade and a corresponding second locking element on the handle that is adapted to engage the first locking element when the blade is in open and/or closed positions. The blade can be mounted on a leaf spring in the handle for pivotal movement relative to the handle between the open and closed positions. The leaf spring functions to support the blade and provide a biasing force that resiliently biases in a direction laterally toward the second locking element on the handle.

17 Claims, 4 Drawing Sheets

FOLDING KNIFE WITH BLADE LOCKING MECHANISM

CROSS-REFERENCE TO RELATED APPLICATION

The present application claims the benefit of U.S. Provisional Application No. 61/182,225, filed May 29, 2009, which is incorporated herein by reference.

FIELD

The present application concerns a folding knife, and more specifically, a locking mechanism for a folding knife.

BACKGROUND

Various types of folding knives having push buttons for unlocking a blade from a locked position are known. Such knives typically are complicated and require a relatively large number of parts. One example is disclosed in U.S. Pat. No. 4,148,140, which discloses a ball latch mechanism that can lock the blade in one of several positions. What is needed is a much simpler locking mechanism for a folding knife having a push button or similar mechanism for disengaging the locking mechanism.

SUMMARY

The present disclosure concerns embodiments of a folding knife having a locking mechanism for locking a blade in open and/or closed positions. The locking mechanism comprises a first locking element on the blade and a corresponding second locking element on the handle that is adapted to engage the first locking element when the blade is in open and/or closed positions. The first locking element can be, for example, one or more locking projections that extend laterally from a side of the blade tang. The second locking element can be one or more locking notches that are sized to receive the locking projections when the blade is in open and/or closed positions.

The blade can be mounted on a leaf spring in the handle for pivotal movement relative to the handle between the open and closed positions. The leaf spring functions to support the blade and provide a biasing force that resiliently biases in a direction laterally toward the second locking element on the handle. The leaf spring causes the first locking element to engage the second locking element when the blade is pivoted to the open position and/or when the blade is pivoted to the closed position. The blade can be released from being locked in the open or closed positions by applying manual pressure to the blade against the biasing force of the leaf spring to move the first locking element out of engagement with the second locking element. The blade can have a button or projection that extends laterally from one side of the blade and has an exposed end surface at one side of the handle that can be pressed inwardly to move the first locking element out of engagement with the second locking element.

In one representative embodiment, a folding knife comprises a handle and a blade. The blade has a tang that is pivotably connected to the handle and is pivotable relative to the handle about a pivot axis between a closed position and an open position. The tang comprises a laterally extending projection and at least one laterally extending locking element. The handle comprises first and second, laterally spaced side portions, the first side portion comprising an aperture and at least one locking notch in communication with the aperture. The projection of the blade tang extends laterally into the aperture such that the projection can rotate within the aperture when the blade is pivoted between its open and closed positions. The second side portion comprises a leaf spring having a free end portion that is resiliently biased toward the first side portion. The free end portion pivotably supports the blade tang by a pivot element extending through the blade tang and the free end portion. The free end portion exerts a biasing force laterally against the blade such that when the blade is pivoted to its open position, the biasing force urges the blade into an open and locked position in which the locking element on the blade extends into and engages the locking notch. The blade can be released from the open and locked position by manually moving the blade laterally against the biasing force to move the locking element out of engagement with the locking notch.

In another representative embodiment, a folding knife comprises a handle and a blade having a tang that is pivotably connected to the handle. The blade is pivotable relative to the handle about a pivot axis between a closed position and an open position. The tang has at least a first locking element. The handle comprises first and second, laterally spaced side portions, the first side portion comprising at least a second locking element adapted to engage the first locking element when the blade is pivoted to its open position. The second side portion comprises a leaf spring having a free end portion that supports the blade tang for pivoting movement of the blade. The free end portion is configured to apply a biasing force that urges the blade toward the second side portion such that when the blade is pivoted to its open position, the biasing force causes the blade to move toward the second side portion and cause the first locking element to engage the second locking element so as to lock the blade in the open position.

In another representative embodiment, a folding knife comprises a handle and a blade having a tang that is pivotably connected to the handle. The blade is pivotable relative to the handle about a pivot axis between a closed position and an open position. The tang has first locking means. The handle comprises a leaf spring having a free end portion that supports the blade tang for pivoting movement of the blade. The handle further comprises second locking means for engaging the first locking means when the blade is in its open position. The free end portion of the leaf spring is configured to apply a biasing force against the blade such that when the blade is pivoted to its open position, the biasing force causes the blade to move laterally toward the second locking means to cause the first locking means to engage the second locking means so as to lock the blade in the open position.

The foregoing and other features and advantages of the invention will become more apparent from the following detailed description, which proceeds with reference to the accompanying figures.

DETAILED DESCRIPTION

Figure 8:
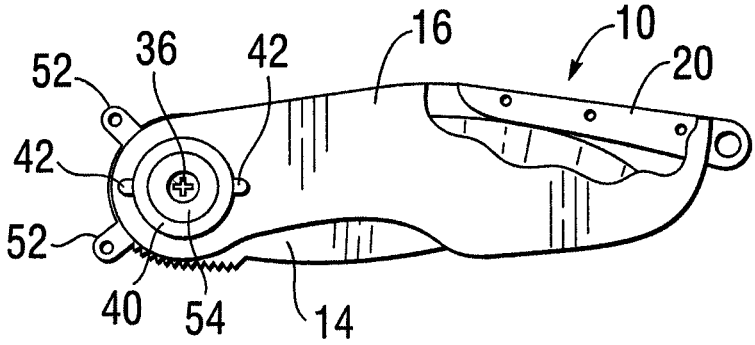
FIG. 8 is a side view of the folding knife of FIG. 1 shown with the blade in the open position.
Figure 9:
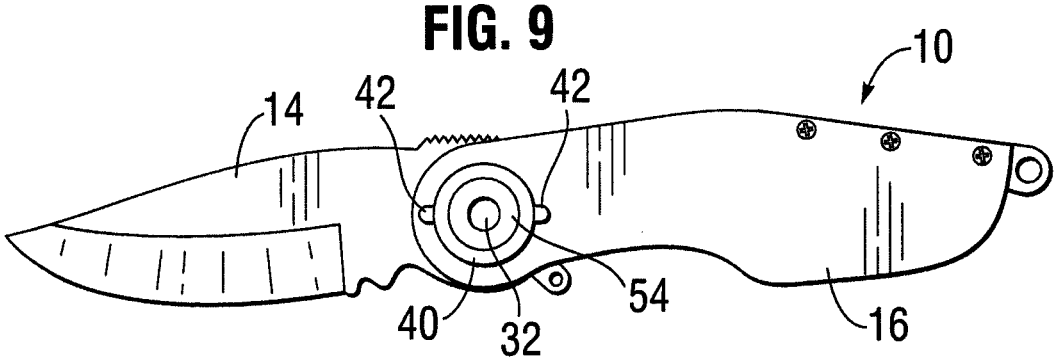
FIG. 9 is a side view of the folding knife of FIG. 1 shown with the blade in the open position.

Referring to the drawings, a folding knife 10, according to one embodiment, comprises a handle 12 and a knife blade 14 pivotably connected to the handle 12. The blade is pivotable relative to the handle between a closed position for storing the blade (FIG. 8) and an open position for using the blade (FIG. 9). The handle 12 comprises a first frame portion 16 (also referred to as a first side portion) and a second frame portion 18 (also referred to a second side portion) separated by a spacer, or spline, 20. Screws 58 can be used to secured the spacer 20 to the frame portions 16, 18. A blade receiving channel is defined between the first and second frame portions 16, 18 for receiving the blade in the closed position. The handle 12 can further include a forward spacer 56 secured between the frame portions 16, 18 adjacent the blade. The forward spacer 56 can also function as a blade stop that contacts the blade when it is folded closed to prevent further pivoting of the blade past the closed position. Although not shown in the drawings, the handle can also include scales and/or bolsters secured to the outer surfaces of the frame portions 16, 18. Such scales and/or bolsters can be used for decorative or aesthetic reasons.

The second frame portion 18 comprises a main body 24 and a biasing element in the form of, for example, a leaf spring 22 that can be integrally formed in the main body 24 of the second frame portion as depicted. In the context of the present application, the phrase "integrally formed" or "integrally connected" means that the leaf spring is machined, cut, or otherwise formed from the same piece of material that forms the main body without any fasteners or welds securing the leaf spring to the main body. In alternative embodiments, however, the biasing element (e.g., leaf spring 22) can be separately formed and subsequently connected to the main body 24 second frame portion, such as with mechanical fasteners or by welding the biasing element to the main body.

Figure 1:
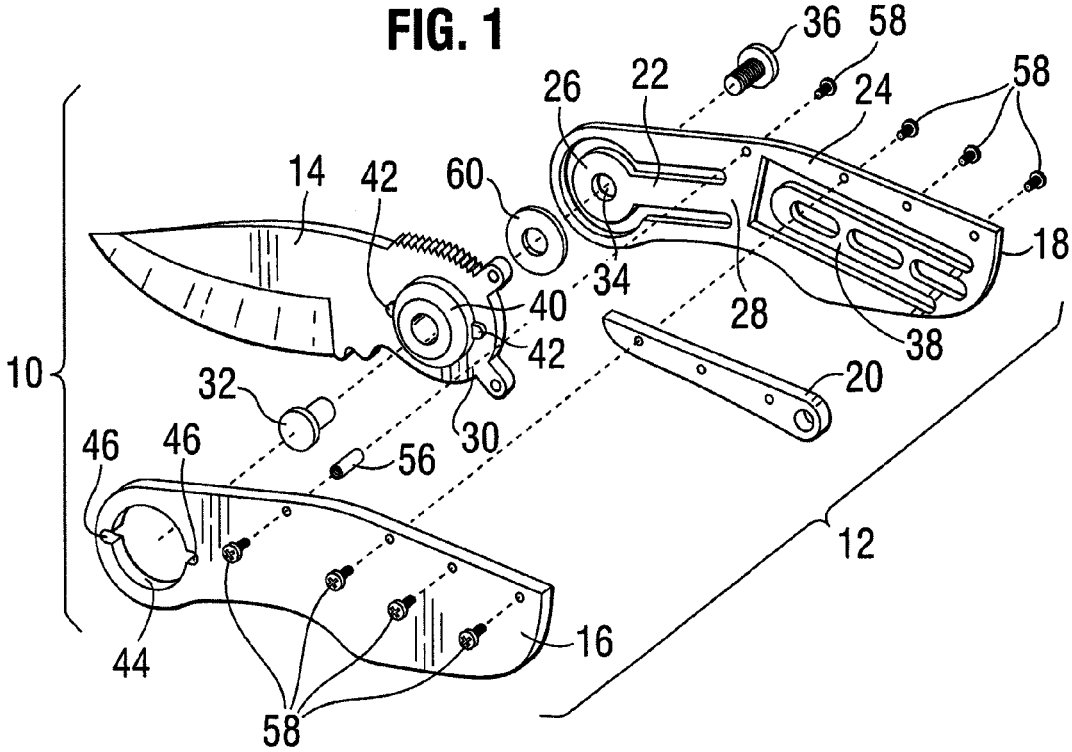
FIG. 1 is a perspective, exploded view of a folding knife, according to one embodiment.
Figure 2:
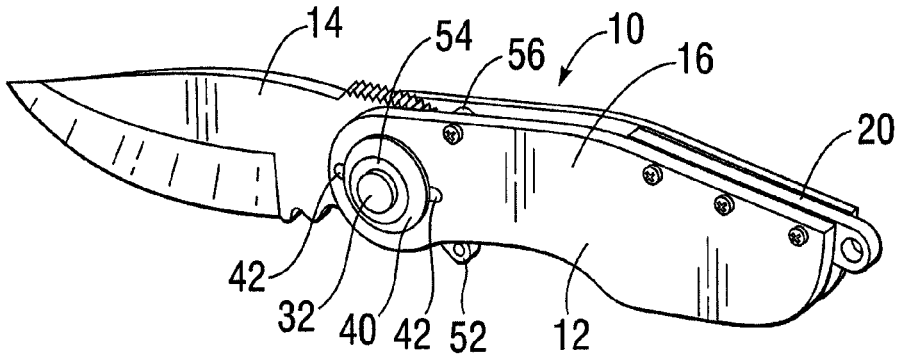
FIG. 2 is a perspective view of the folding knife of FIG. 1.
Figure 3:
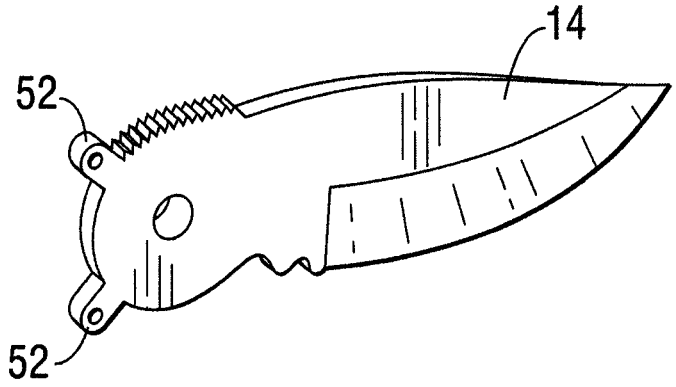
FIG. 3 is a perspective view of the blade of the folding knife of FIG. 1.
Figure 4:
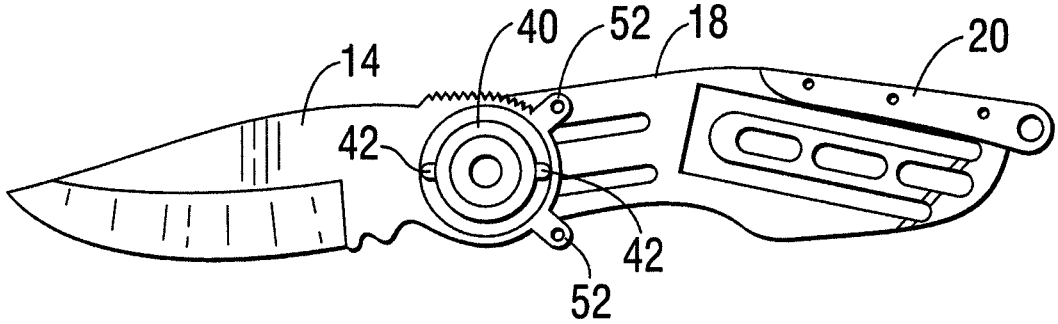
FIG. 4 is side view of the folding knife of FIG. 1 shown with one side of the handle removed for purposes of illustration.
Figure 5:
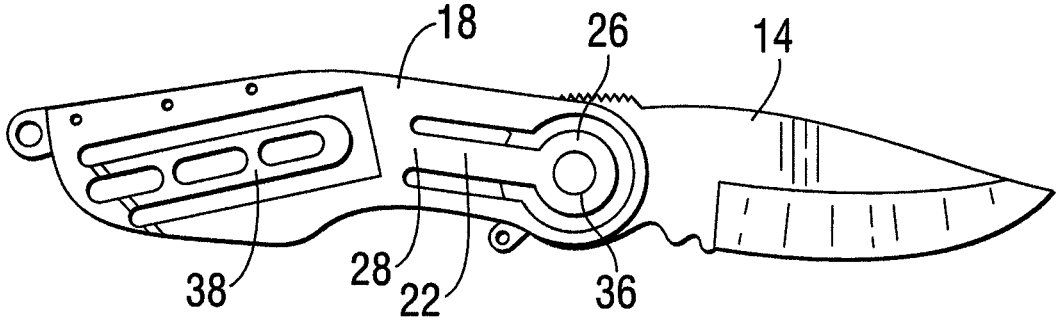
FIG. 5 shows the opposite side of the folding knife shown in FIG. 4.
Figure 6:
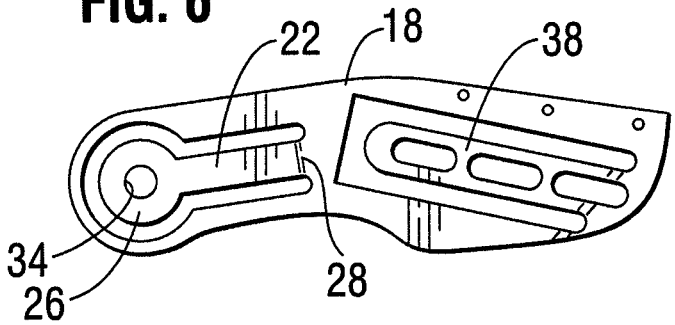
FIG. 6 is a side view of one of the frame portions of the folding knife of FIG. 1 having an integral leaf spring and belt clip.

As best shown in FIG. 6, the leaf spring 22 has a distal free end portion 26 and a proximal fixed end portion 28 that is integrally connected to the main body 24 of the second frame portion. Referring to FIG. 1, the blade 14 has a tang portion 30 that is pivotably connected to the free end portion 26 of the leaf spring, such as by a pivot element, or pivot pin, 32 that extends through a central opening 34 of the free end portion 26, a washer 60, and a corresponding opening in the blade tang 30. A pivot screw 36 extends and is tightened into a threaded bore of the pivot pin 32 in a conventional manner.

The leaf spring 22 functions to bias the blade 14 laterally toward the first frame portion 16 to lock the blade in the open and/or closed positions, as further described below. In alternative embodiments, the biasing element can take other forms, such as a coil spring or other resilient member interposed between the blade and the second frame portion.

Figure 7:
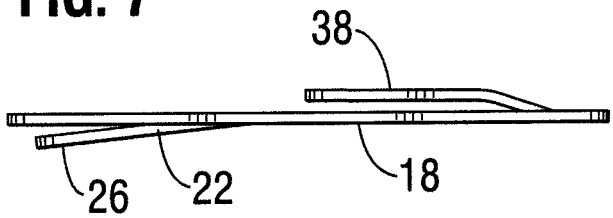
FIG. 7 is a top plan view of the frame portion shown in FIG. 6.

The second frame portion 18 can also include a spring clip 38 for clipping the knife to a pocket, belt, etc. The clip 38 can be integrally formed as shown or separately formed and subsequently attached to the second frame portion or at another location on the handle. As best shown in FIG. 7, the leaf spring 22 is bent to extend laterally outwardly from one side of the second frame portion and the spring clip 38 is bent to extend laterally outwardly from the opposite side of the second frame portion.

The blade tang 30 in the illustrated embodiment includes a laterally extending main projection 40 and one or more laterally extending first locking elements in the form of locking pins, or projections, 42. The first frame portion 16 is formed with a main opening 44 that is complementary to the projection 40 and one or more second locking elements in form of locking notches 46 in communication with the main opening 44 that are sized to receive the locking pins 42. In the illustrated embodiment, as best shown in FIG. 1, the locking pins 42 are positioned on diametrically opposed sides of the main projection 40 and extend laterally from one side of the blade tang a distance less than the main projection.

Desirably, the main projection 40 has a circular cross-sectional profile (perpendicular to the pivot axis of the blade) and the main opening 44 is circular to allow the main projection 40 to rotate within the main opening 44 when the blade is pivoted from the closed position to the open position, and vice versa. The main projection 40 desirably extends slightly beyond the outer side surface of the second frame portion 16 and has an exposed end surface 54 at the side of the handle that serves as a button or pressing surface for applying manual pressure against the blade when unlocking the knife. In the illustrated configuration, the main projection 40 is integrally formed as part of the blade tang. It should be noted, however, that the projection 40 can be separate component that is held in place against the side of the blade tang 30 by the pivot pin 32.

Figure 10:
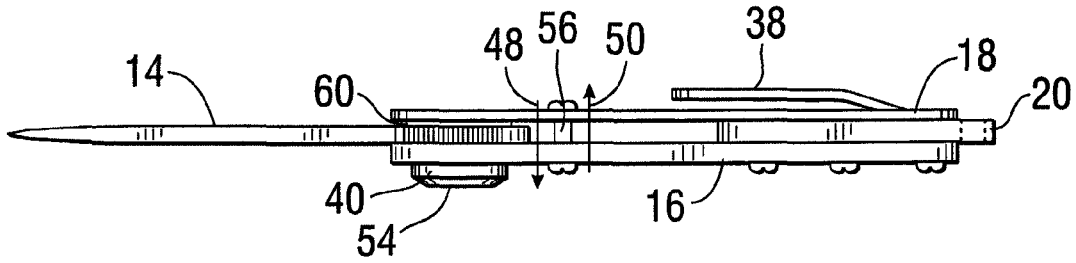
FIG. 10 is a top plan view of the folding knife of FIG. 1 shown with the blade in the open position.
Figure 11:
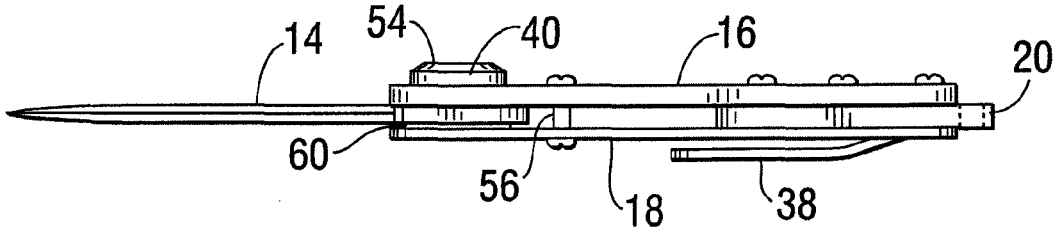
FIG. 11 is a bottom plan view of the folding knife of FIG. 1 shown with the blade in the open position.

When the blade is in the closed position (FIG. 8), the locking pins 42 are received in the notches 46. The spring force of the leaf spring 22 forces the blade laterally against the first frame portion 16 (as indicated by arrow 48 in FIG. 10), thereby retaining the locking pins 42 in the notches and preventing rotation of the blade relative to the handle. To open the blade, the user first applies a manual force against the main projection 40 in a direction laterally toward the second frame portion 18 (as indicated by arrow 50 in FIG. 10) sufficient to overcome the force of the leaf spring and move the blade laterally a distance until the locking pins 42 are moved out of the notches 46.

While maintaining manual pressure laterally against the blade to keep the locking pins out of the notches, the blade can be pivoted to the open position by applying a rotational force to the blade in a conventional manner. To assist in rotating or "flipping" the blade open, the blade can include projections 52 (referred to as "flippers'). When the blade reaches the open position (which is about 180 degrees from the closed position in the illustrated embodiment), the locking pins 42 become aligned with the notches 46 and the leaf spring 22 forces the locking pins into the notches so as to lock the blade in the open position (referred to as the open and locked position). The blade can be pivoted closed in a similar manner by first moving the blade laterally to move the locking pins out of the corresponding notches and then rotating the blade until it reaches the closed position and the locking pins again become aligned with the notches, allowing the leaf spring to push the locking pins into the notches.

In the illustrated embodiment, there are two locking pins 42 extending from the side of the blade and a corresponding number of locking notches. In other embodiments, the blade can have only one locking pin 42 or more than two locking pins spaced around the main projection 40, and a corresponding number of locking notches. Also, the number of locking notches need not correspond to the number of locking pins. For example, the blade can have one locking pin 42 and the handle can have two locking notches, one of which is positioned to receive the locking pin when the blade is open and the other of which is positioned to receive the locking pin when the blade is closed.

Moreover, in alternative embodiments, the positions of the locking pins 42 and the locking notches 46 can be reversed. In other words, the blade tang 30 can be formed with one or more locking notches and the first frame portion 16 can have one or more complimentary locking pins or projections that extend into the notches on the blade.

In the illustrated embodiment, the blade is configured to pivot 180 degrees between the open and closed positions. Also, the locking pins 42 are spaced 180 degrees apart from each other, and so are the locking notches 46. As such, the locking pins 42 can extend into and engage the locking notches 46 when the blade is in the closed position and the open position. However, it should be noted that the positions of the locking pins 42 and/or the locking notches 46 and/or the rotation of the blade can be modified to allow the locking pins 42 to engage the locking notches in the open position or the closed position but not both.

For example, the locking pins 42 can be positioned so that they are aligned with the locking notches 46 when the blade is in the open position and the blade can be configured to pivot about 175 degrees. Thus, in this specific example, the locking pins 42 extend into the locking notches 46 when the blade is opened (and therefore lock the blade in the open position), but when the blade is pivoted closed, the locking pins 42 do not become aligned with the locking notches 46 since the blade does not rotate a full 180 degrees. As such, the locking pins 42 cannot engage the locking notches to lock the blade in the closed position. Instead, the locking pins 42 bear against the inner surface of the first frame portion 16 under the force of the leaf spring 22. The force of the leaf spring 22 pressing the locking pins 42 against the inner surface of the first frame portion 16 desirably is sufficient to keep the blade from opening under its own weight. In this manner, the locking mechanism (including the locking pins and the locking notches) locks the blade in the open position and protects against inadvertent closing of the blade while the blade is being used, and when the blade is closed, the locking mechanism is effectively inactive or non-engaged so that the blade can be easily pivoted from the closed position without having to first manually disengage the locking mechanism.

As noted above, referring to FIG. 8, the blade can include projections 52 to assist in opening the blade. The projections 52 desirably are non-parallel to each other and desirably are oriented at an angle of about 10 to 170 degrees relative to each other, with 90 degrees being a specific example. The projections 52 can be used to open the blade in several different ways. For example, the blade can be opened by applying a rotating force to the upper projection 52 in FIG. 8 (usually with the index finger) while simultaneously flicking the wrist with sufficient force to completely open the blade. In another example, the blade can be opened by applying a rotating force to the lower projection 52 in FIG. 8 with the thumb. Due to the position of the lower projection 52, the blade can be pivoted through its full range using only the thumb. In another example, the blade can be opened using only the index finger (and without flicking the wrist) by first applying a rotating force to the upper projection 52 with the index finger to partially open the blade and then subsequently applying a rotating force to the lower projection 52 to further pivot the blade from the partially open position to the fully open position.

Figure 12:
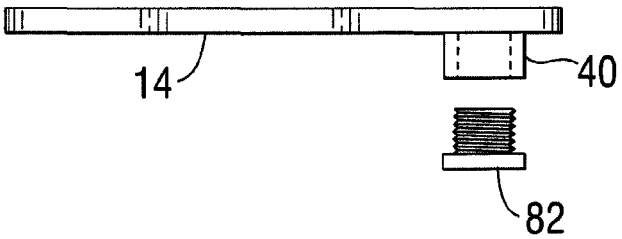
FIG. 12 is an exploded view of a blade and an optional push button that is connected to a side of the blade.

If desired, an optional button, or extension, 82 (FIG. 12) can be coupled the main projection 40 so as to extend laterally outwardly from the main opening 44 in the frame portion 16. The button 82 is exposed at the side of the side of the handle and can be depressed by a user to move the blade laterally against the bias of the leaf spring when unlocking the blade.

Figure 13:
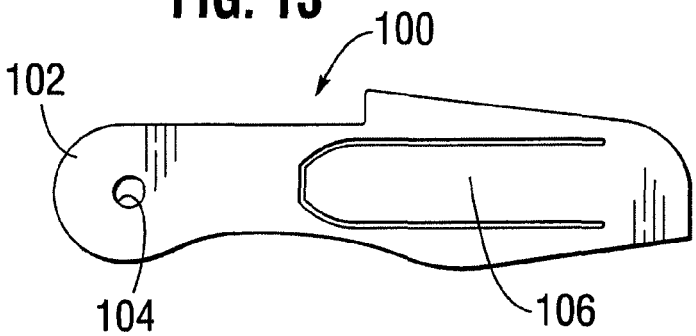
FIG. 13 is a side view of an alternative embodiment of a frame portion having an integral leaf spring for supporting the blade.

FIG. 13 illustrates an alternative frame portion 100 that can be used in lieu of frame portion 18. In this embodiment, the entire distal end portion 102 of the frame portion 100 functions as the leaf spring and supports the blade in a pivotable manner, such as via a pivot pin that extends through an opening 104. The frame portion 100 can be formed with an optional belt clip 106.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A folding knife comprising:

a handle;

a blade having a tang that is pivotably connected to the handle and being pivotable relative to the handle about a pivot axis between a closed position and an open position, the tang comprising a laterally extending projection and one or more laterally extending locking elements; and the handle comprising first and second laterally spaced side portions, the first side portion comprising an aperture and one or more locking notches in communication with the aperture, the projection of the blade tang extending laterally into the aperture such that the projection can rotate within the aperture when the blade is pivoted between its open and closed positions;

the second side portion comprising a leaf spring having a free end portion that is resiliently biased toward the first side portion, the free end portion pivotably supporting the blade tang by a pivot element extending through the blade tang and the free end portion, the free end portion exerting a biasing force laterally against the blade such that when the blade is pivoted to its open position, the biasing force urges the blade into an open and locked position in which the one or more locking elements on the blade extend into and engage the one or more locking notches, and wherein the blade can be released from the open and locked position by manually moving the blade laterally against the biasing force to move the one or more locking elements out of engagement with the one or more locking notches.

2. The folding knife of claim 1, wherein the aperture in the first side portion is circular and the laterally extending projection has a circular cross-sectional profile perpendicular to the pivot axis.

3. The folding knife of claim 1, wherein the one or more locking elements comprise first and second locking elements on diametrically opposing sides of the projection, and the one or more locking notches comprise first and second locking notches in communication with the aperture, the first and second locking notches receiving the first and second locking elements, respectively, when the blade is in the open and locked position.

4. The folding knife of claim 1, wherein the leaf spring is integrally formed in the second side portion.

5. The folding knife of claim 1, wherein the one or more locking notches comprise first and second locking notches, and wherein when the blade is pivoted to its open position, the biasing force urges the blade into the open and locked position in which one of the one or more locking elements on the blade extends into and engages the first locking notch, and when the blade is pivoted to its closed position, the biasing force urges the blade into a closed and locked position in which the one of the one or more locking elements on the blade extends into and engages the second locking notch.

6. The folding knife of claim 1, wherein the projection extends laterally outward from a side of the blade tang a first distance and the one or more locking elements extend laterally outward from the side of the blade tang a second distance that is less than the first distance.

7. A folding knife comprising:

a handle;

a blade having a tang that is pivotably connected to the handle and being pivotable relative to the handle about a pivot axis between a closed position and an open position, the tang having a first locking element; and the handle comprising first and second laterally spaced side portions, the first side portion comprising a second locking element adapted to engage the first locking element when the blade is pivoted to its open position;

the second side portion comprising a leaf spring having a free end portion that supports the blade tang for pivoting movement of the blade, the pivot axis extending through the free end portion of the leaf spring, and the free end portion being configured to apply a biasing force that urges the blade toward the first side portion such that when the blade is pivoted to its open position, the biasing force causes the blade to move toward the first side portion and cause the first locking element to engage the second locking element so as to lock the blade in the open position.

8. The folding knife of claim 7, wherein the first locking element comprises a locking projection that extends laterally outward from a side surface of the blade tang, and the second locking element is a locking notch formed in the first side portion, the locking notch being adapted to receive the locking projection when the blade is pivoted to its open position.

9. The folding knife of claim 8, further comprising a projection mounted on one side of the blade tang and extending through an aperture in the first side portion, the projection having an exposed end surface at one side of the handle for applying manual pressure to the blade against the biasing force in order to move the first locking element out of engagement with the second locking element.

10. The folding knife of claim 7, wherein the second side portion comprises a main body portion and the leaf spring comprises a fixed end portion that is integrally connected to the main body portion.

11. The folding knife of claim 7, wherein the first side portion comprises a third locking element, and when the blade is pivoted to its closed position, the biasing force causes the blade to move toward the first side portion and cause the first locking element to engage the third locking element so as to lock the blade in the closed position.

12. The folding knife of claim 7, wherein when the blade is in its closed position, the first locking element does not engage the second locking element but the biasing force of the leaf spring against the blade creates enough resistance between the blade and the first side portion to prevent the blade from opening under its own weight.

13. A folding knife comprising:

a handle;

a blade having a tang that is pivotably connected to the handle and being pivotable relative to the handle about a pivot axis between a closed position and an open position, the tang having first locking means; and the handle comprising a leaf spring having a free end portion that supports the blade tang for pivoting movement of the blade, the pivot axis extending through the free end portion of the leaf spring, and the handle further comprising second locking means for engaging the first locking means when the blade is in its open position;

the free end portion of the leaf spring being configured to apply a biasing force against the blade such that when the blade is pivoted to its open position, the biasing force causes the blade to move laterally toward the second locking means to cause the first locking means to engage the second locking means so as to lock the blade in the open position.

14. The folding knife of claim 13, further comprising a pivot pin defining the pivot axis and extending through the free end portion of the leaf spring and the blade tang.

15. The folding knife of claim 13, wherein when the blade is pivoted to its closed position, the biasing force causes the first locking means to engage the second locking means so as to lock the blade in the closed position.

16. The folding knife of claim 13, wherein the first locking means comprises at least one projection that extends laterally from a side of the blade tang and the second locking means comprises at least one notch in the handle that is adapted to receive the at least one projection.

17. A folding knife comprising:

a handle;

a blade having a tang that is pivotably connected to the handle and being pivotable relative to the handle about a pivot axis between a closed position and an open position, the tang comprising a laterally extending projection and at least one laterally extending locking element; and the handle comprising first and second laterally spaced side portions, the first side portion comprising an aperture and at least one locking notch in communication with the aperture, the projection of the blade tang extending laterally into the aperture such that the projection can rotate within the aperture when the blade is pivoted between its open and closed positions;

the second side portion comprising a leaf spring having a free end portion that is resiliently biased toward the first side portion, the free end portion pivotably supporting the blade tang by a pivot element extending through the blade tang and the free end portion, the free end portion exerting a biasing force laterally against the blade such that when the blade is pivoted to its open position, the biasing force urges the blade into an open and locked position in which the at least one locking element on the blade extends into and engages the at least one locking notch, and wherein the blade can be released from the open and locked position by manually moving the blade laterally against the biasing force to move the at least one locking element out of engagement with the at least one locking notch;

the pivot element defining the pivot axis;

wherein the aperture in the first side portion is circular and the laterally extending projection has a circular cross-sectional profile perpendicular to the pivot axis;

wherein the at least one locking element comprises first and second locking elements on diametrically opposing sides of the projection, and the at least one locking notch comprises first and second locking notches in communication with the aperture;

wherein when the blade is in the open and locked position, the first locking element is received in the first locking notch and the second locking element is received in the second locking notch;

wherein when the blade is pivoted to its closed position, the biasing force urges the blade into a closed and locked position in which the first locking element is received in the second locking notch and the second locking element is received in the first locking notch;

wherein the second side portion comprises a main body portion and the leaf spring comprises a fixed end portion that is integrally connected to the main body portion.

* * * * *